US011661688B2

(12) United States Patent
Nandgaonkar

(10) Patent No.: US 11,661,688 B2
(45) Date of Patent: May 30, 2023

(54) MULTI-PLY DISPERSIBLE NONWOVEN FABRIC

(71) Applicant: Suominen Oyi, Helsinki (FI)

(72) Inventor: Avinav G. Nandgaonkar, Manchester, CT (US)

(73) Assignee: Suominen Oyj, Helsinki (FI)

( * ) Notice: Subject to any disclaimer, the term of this patent is extended or adjusted under 35 U.S.C. 154(b) by 671 days.

(21) Appl. No.: 16/484,466

(22) PCT Filed: Feb. 8, 2018

(86) PCT No.: PCT/FI2018/050091

§ 371 (c)(1),
(2) Date: Aug. 8, 2019

(87) PCT Pub. No.: WO2018/146385

PCT Pub. Date: Aug. 16, 2018

(65) Prior Publication Data

US 2020/0095714 A1 Mar. 26, 2020

Related U.S. Application Data

(60) Provisional application No. 62/456,199, filed on Feb. 8, 2017.

(51) Int. Cl.
*D04H 1/64* (2012.01)
*D04H 1/26* (2012.01)
(Continued)

(52) U.S. Cl.
CPC ..... *D04H 1/64* (2013.01); *D04H 1/26* (2013.01); *D04H 1/28* (2013.01); *D04H 1/32* (2013.01);
(Continued)

(58) Field of Classification Search
CPC .. D04H 1/64; D04H 1/26; D04H 1/28; D04H 1/32; D04H 1/49; D04H 1/492; D04H 1/593; D04H 1/58
See application file for complete search history.

(56) References Cited

U.S. PATENT DOCUMENTS 6,187,141 B1 2/2001 Takeuchi et al.
6,190,502 B1 2/2001 Takeuchi et al.
(Continued)

FOREIGN PATENT DOCUMENTS

EP 0904933 A2 3/1999
EP 2148950 B1 10/2012
(Continued)

*Primary Examiner* — Jacob T Minskey
*Assistant Examiner* — Matthew M Eslami
(74) *Attorney, Agent, or Firm* — Laine IP Oy

(57) ABSTRACT

The invention relates to a nonwoven fabric material having sufficient strength to be used in a pre-moistened state but also having dispersibility properties which allow the product to be flushed. The material comprises at least two nonwoven webs, at least one of which is hydroentangled. Each of the individual webs comprise 50%-95% wood pulp and 5%-50% of short cut man-made fibers and/or natural fibers and has a basis weight of 20-100 gsm. After forming the webs, the two nonwoven webs are dried and then joined together by particle binders through size press or spraying. The particle binder joined webs separate into individual webs after flushing due to the breakage of particle binder-nonwoven hydrogen bond which makes the material highly dispersible.

18 Claims, 2 Drawing Sheets

(51) Int. Cl.

| | |
|---|---|
| ***D04H 1/28*** | (2012.01) |
| ***D04H 1/32*** | (2012.01) |
| ***D04H 1/49*** | (2012.01) |
| ***D04H 1/492*** | (2012.01) |
| ***D04H 1/593*** | (2012.01) |

(52) U.S. Cl.
CPC ..... *D04H 1/49* (2013.01); *D04H 1/492* (2013.01); *D04H 1/593* (2013.01)

(56) References Cited

U.S. PATENT DOCUMENTS

| | | | | |
|---|---|---|---|---|
| 6,258,210 | B1 | 7/2001 | Takeuchi et al. | |
| 6,749,718 | B2 | 6/2004 | Takai et al. | |
| 7,285,504 | B2 | 10/2007 | Jones et al. | |
| 7,456,117 | B2 | 11/2008 | Branham et al. | |
| 7,585,797 | B2 | 9/2009 | Vogel et al. | |
| 7,838,725 | B2 | 11/2010 | Noda et al. | |
| 8,193,104 | B2 | 6/2012 | Parsons et al. | |
| 8,603,297 | B2 | 12/2013 | Zwick et al. | |
| 9,314,142 | B2 | 4/2016 | Baker et al. | |
| 2003/0000665 | A1* | 1/2003 | Takai ..... | D21H 25/005 162/146 |
| 2006/0037724 | A1 | 2/2006 | Akai et al. | |
| 2015/0330029 | A1* | 11/2015 | Ramaratnam ..... | B32B 5/26 162/111 |
| 2016/0051115 | A1 | 2/2016 | Smith | |
| 2016/0303002 | A1 | 10/2016 | Cunningham et al. | |

FOREIGN PATENT DOCUMENTS

| | | | |
|---|---|---|---|
| EP | 2627229 | B1 | 1/2016 |
| EP | 1320458 | B2 | 3/2016 |
| WO | WO2015176063 | A1 | 11/2015 |

* cited by examiner

MULTI-PLY DISPERSIBLE NONWOVEN FABRIC

FIELD OF THE INVENTION

The present invention relates to products which are flushable, that is disposable through a water closet system without risk of clogging sewer pipes. More particularly, the present invention relates to a nonwoven material having sufficient strength to be used in a pre-moistened state but also having dispersability properties which allow the product to be flushed.

BACKGROUND

Ordinary toilet paper is designed for use in the dry state, and when flushed down the toilet it is readily disperses so as to flow down a properly draining sewer system without causing any blockage. A moist tissue such as products used for e.g. baby care and personal hygiene must necessarily have further properties in order to be useful in the wet state in which they are delivered. These products must also be maintained in their pre-moistened state for a considerable time between manufacture and use. However, for obvious reasons it is often desirable to dispose of used wet wipes by flushing them down the toilet.

In order to provide sufficient wet strength in pre-moistened wipes, a wet strength agent is often added. Such agents may be a cause of insufficient disintegration properties. Though wet strength agents and water soluble adhesives at some point dissolve in water, the dispersibility of the product may not be fast enough to eliminate blockage risks. Another approach to dispersability is the use of various fiber length compositions. Short fibers may provide good dispersability but do not provide the desired surface and "feel" characteristics that are required in wipes. Long fibers again are prone to accumulating on screens and the like in sewer systems, again leading to blockage problems.

In EP 0 904 933 is disclosed a water-disintegratable wiping sheet comprising two webs both containing pulp fibers but of different composition, one web comprising water-swellable binder.

In EP 2 148 950 is disclosed a dispersible nonwoven web having at least three layers of specified compositions of short and long fibers, and comprising a triggerable binder, the binder being one that is not soluble in the wetting composition but is dispersible or soluble in the aqueous conditions encountered in the flushing situation.

In U.S. Pat. No. 8,603,297 is disclosed a dispersible wet wipe comprising at least a first layer which is preferably an uncreped air dried tissue web, and a second layer which may be a nonwoven web. The material further comprises a triggerable binder and a wetting composition.

In U.S. Pat. No. 7,838,725 is disclosed a dispersible absorbent product having a mechanically weakened multi-layered structure comprising at least two layers joined together in a staggered manner such that the mechanically weakened regions are not directly superimposed over each other. The layers may be joined by applying pressure and/or heat, using adhesives or e.g. using ultrasonic bonding.

In U.S. Pat. No. 9,314,142 is disclosed a dispersible multilayer wipe material based on the combination of cellulosic fiber, bicomponent fiber and a coated binder.

In U.S. Pat. No. 6,187,141 is disclosed multiple nonwovens which are joined together by a water insoluble or water swellable binder.

The use of binders in nonwovens having dispersibility properties is further disclosed in U.S. Pat. Nos. 6,258,210; 7,585,797; 8,603,297.

Single nonwovens which are treated with binder are disclosed in US 20160051115; US 20060037724; U.S. Pat. Nos. 7,285,504; 6,190,502; 8,193,104; 7,456,117 and 6,749,718.

Some of these moist toilet tissue materials were designed to have sufficient wet strength for use and for dispensing. In order to have that strength, the material may include synthetic fibers. However, those fibers are longer in length as compared to wood pulp which causes problem of clogging, inefficient dispersion, and takes a longer time for full dispersion apart from the higher cost of those fibers.

Ion-sensitive water dispersible polymer provides in-use strength and disperses in water. However, the dispersion of binder is highly dependent on the water hardness and temperature. Moreover, salt sensitive lotion and binder can be harmful to the skin.

SUMMARY OF THE INVENTION

The present invention provides a dispersible nonwoven material which avoids the use of oil-based synthetic fiber. The material comprises at least two nonwoven webs, at least one of which is hydroentangled. Each of the individual webs comprise 50%-95% wood pulp and 5%-50% of short cut man-made fibers and/or natural fibers and has a basis weight of 20-100 gsm. Each individual nonwoven web is highly dispersible because of its low basis weight. Each individual nonwoven web has wet MD strength of 200 g/50 mm to 600 g/50 mm. After forming the webs, the two nonwoven webs are dried and then joined together by particle binders through size press or spraying. Due to the crystalline nature of the particle binder, the two nonwoven webs are held together in presence of the wetting solution as a three dimensional network of hydrogen bonding is formed. This results in a combined web having significantly higher wet strength than the individual webs. The particle binders are hydrophilic in nature, swells in presence of water, and tends to bind with the cellulosic fibers through hydrogen bonds. This provides the required strength, stability, in-use and dispensing strength to the nonwoven product but allows it to split into two or multiple webs which disperse after flushing down with mild agitation in water. The particle binder joined webs separates into individual webs after flushing due to the breakage of particle binder-nonwoven hydrogen bond which makes the material highly dispersible.

DETAILED DISCLOSURE

Figure 1:
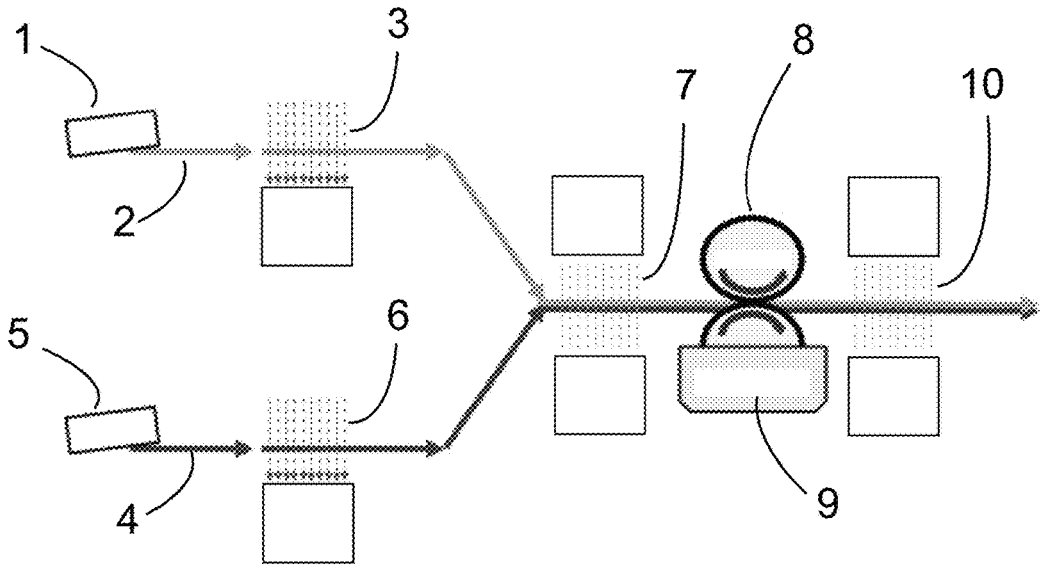
FIG. 1 shows a method for preparing a nonwoven material according to an embodiment of the invention.

The material of the invention comprises at least two individual nonwoven web layers formed separately. At least one, preferably several of the webs is/are hydroentangled.

The hydroentanglement is carried out using wet laid technology with a composition of 50%-95% wood pulp and 5%-50% short cut fibers and/or natural fibers. The short cut fibers of flushable wipes are man-made fibers which are non-thermoplastic. Non-limiting examples of short-cut man-made fibers useful in the dispersible nonwoven material of the invention are regenerated cellulose, lyocell, viscose rayon, polylactic acid and polyvinyl alcohol. The present invention avoids the use of any glass fiber and oil-based synthetic fibers such as polyester, nylon, polypropylene, polycarbonates, polyethylene, polyvinyl chloride, aramid, polyacrylate, and combinations thereof. The natural fibers might be cotton, hemp, flax, linen, bamboo, sisal, jute, kapok, etc. The fiber length of the short cut man-made fibers and/or natural fibers useful in the dispersible nonwoven material of the invention is in the range of 5 mm to 15 mm. Each individual nonwoven web preferably has a basis weight of 20 gsm to 100 gsm. Each individual nonwoven web preferably has a wet strength of 100 g/50 mm to 600 g/50 mm.

After hydroentanglement, the two nonwoven webs are dried (using e.g. drying cans) and then joined together by means of a particle binder. A particle binder is a co-processed composite of microcrystalline cellulose (MCC) and sodium carboxymethylcellulose (Na-CMC). Particle binders are commercially available under the names VIVAPUR® COS 8 from JRS pharma; Avicel® RC and Avicel® CL from FMC Biopolymer; SANCEL® 581, RC 591, and RC 611 from NB Entrepreneurs. These products are used as thickeners, stabilizers, and blending agents in the pharmaceutical, food, and personal care industries. The range of the MCC/Na-CMC ratio may vary from 80/20 to 95/5.

Particle binder dispersed in water at a concentration of 0.5% to 4%, having a binder particle size of 2 μm to 150 μm can be applied on the nonwoven web through a size press or by spraying. After the application of particle binder, the composite web is dried through a dry can at a temperature of 160° C. This process joins the two nonwoven webs so they are held together in the presence of a wetting solution.

The composite web has a significantly higher strength than the individual webs. The joined particle binder treated fabric material provides sufficient in-use and dispensing strength to the product, but splits into its component webs and disperses fast after flushing down with mild agitation in water. The dispersibility of the subject material is according to GD 3 guidelines; 50 to 100% pass through after 5 min.

The final basis weight for the nonwoven material according to the present invention is in the range 40 to 120 gsm. Preferably, the wet strength in the conditions of use of the nonwoven according to the present invention is greater than 250 g/50 mm.

To prepare wet wipes, the nonwoven fabric material according to the present invention is treated with a wetting liquid. Advantageously, the wetting liquid may comprise about 98% water and about 2% preservative, for example Lonza Geogard® 221. Preferably, wetting liquid is used in an amount not exceeding 2.5 times the weight of the dry nonwoven material per unit area.

In general, the wetting liquid may further comprise additional agents such as emollients, viscosity modifier, natural or synthetic oil and fats, surfactants, antimicrobial agents, particulates, alcohol, salts, organic solvents, pharmaceutical agents such as dimethyl sulfoxide; odor control agents, detergents, silicones, fragrance, pH control agents, whitening agents and surface feel modifiers.

Description of Preferable Embodiments

FIG. 1 is a schematic representation of an embodiment of a process for preparing a nonwoven according to the present invention. Stock is prepared in a first headbox 1 and a first web 2 is laid wet according to procedures known to the person skilled in the art. For example, the web is laid on a plastic wire running at a speed of 2 to 4 m/s (400-800 feet/min) and transferred to the hydroentangling station where the fibrous structure is entangled using first high pressure jets 3. The web is hydroentangled by 3 to 5 different consecutive nozzles with a water jet pressure of 2.75-5.5 MPa (400-800 psi) and laid on top of a second wet laid web 4 prepared using second head box 5 and second high pressure jets 6 in an analogous manner but not necessarily using identical parameters. The wet laid webs have a composition of 50-95% wood pulp fibers and 5-50% shortcut fibers. The proportion of shortcut fiber to wood pulp fiber depends on the type of shortcut fiber used. If the shortcut fibers are of flat cross-section and of short length, then a higher proportion of shortcut fiber is required, and if the fiber is of round cross-section and of long length, then the proportion of shortcut fiber will be low. Preferably, at least 20% of shortcut fiber is used.

An example of wood pulp fiber which may be used in a nonwoven according to the invention is Grande Prairie ECF Northern Bleached Softwood. An example of shortcut fiber which may be used in a nonwoven according to the invention is Danufil® 1.7 dtex 8 mm from Kelheim Fibres GmbH, Germany. Cotton fiber is a further alternative to be used as shortcut fiber.

Following drying 7, the combined web 2, 4 is conducted through a size press 8, where particle binder 9 is applied. The amount of particle binder is of 1% and 2% with a ratio of 85/15 MCC/Na-CMC. It may be applied through coating, size press or spraying.

Subsequent drying 10 is carried out as required.

Examples

Table 1 shows the composition and ID of the samples prepared.

TABLE 1

Various nonwoven webs with different fiber composition and basis weight.

| Composition | Sample ID |
|---|---|
| Using 20% Danufil 1.7 dtex × 8 mm, 80% Wood - 40 gsm | A2 |
| Using 30% Danufil 1.7 dtex × 8 mm, 70% Wood - 40 gsm | B2 |
| Using 20% Danufil 1.7 dtex × 8 mm, 80% Wood - 60 gsm | C |
| Using 30% Danufil 1.7 dtex × 8 mm, 70% Wood - 60 gsm | D |
| Using 20% Danufil 1.7 dtex × 8 mm, 80% Wood - 40 gsm-No Entanglement | E |

In Table 1, Danufil® 1.7 dtex×8 mm and Grande Prairie (ECF—Elemental Chlorine Free) Northern Bleached Softwood pulp were used as a short cut fiber and wood pulp, respectively. The two/multiple webs were joined together by particle binder (Commercial name Vivapur® Cos 8 manufactured by J. Rettenmaier USA LP). Cos 8 consists of a mixture of microcrystalline cellulose and sodium carboxymethylcellulose in powder form with a ratio of 85/15.

Figure 2:
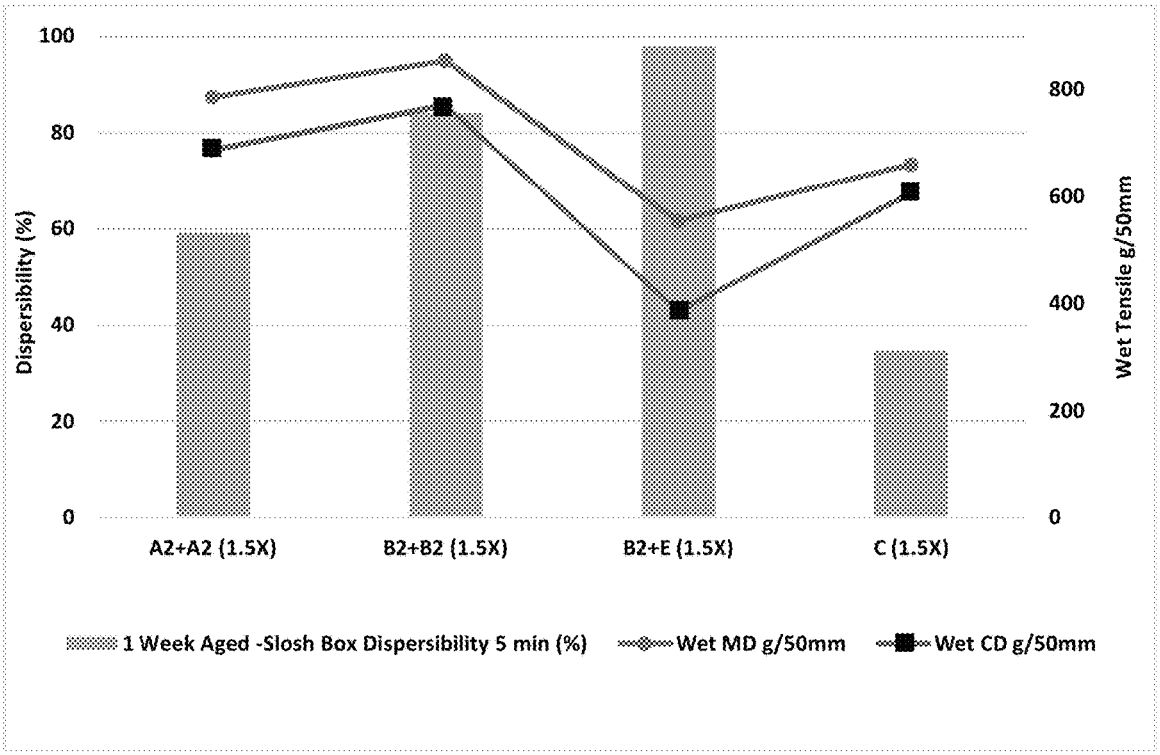
FIG. 2 shows wet MD and CD strength (line graph) and the slosh box (bar graph) profile of various nonwoven webs (multiple webs and single web) joined together by particle binder (1%) using a size press.

FIG. 2 shows the dispersibility (bars) and wet MD and CD data (lines) for four combination pairs of webs as shown in Table 1, using 1% of particle binder. Sample B2+B2 has wet MD of more than 800 g/50 mm with the dispersibility of greater than 80% after 5 min according to INDA/EDANA flushability GD3 guidelines. In FIG. 2, 1.5× denotes the hydroentanglement pressure used to make nonwoven web. 1.5× represents 400, 400 and 500 psi using three separate hydroentanglement nozzles.

Figure 3:
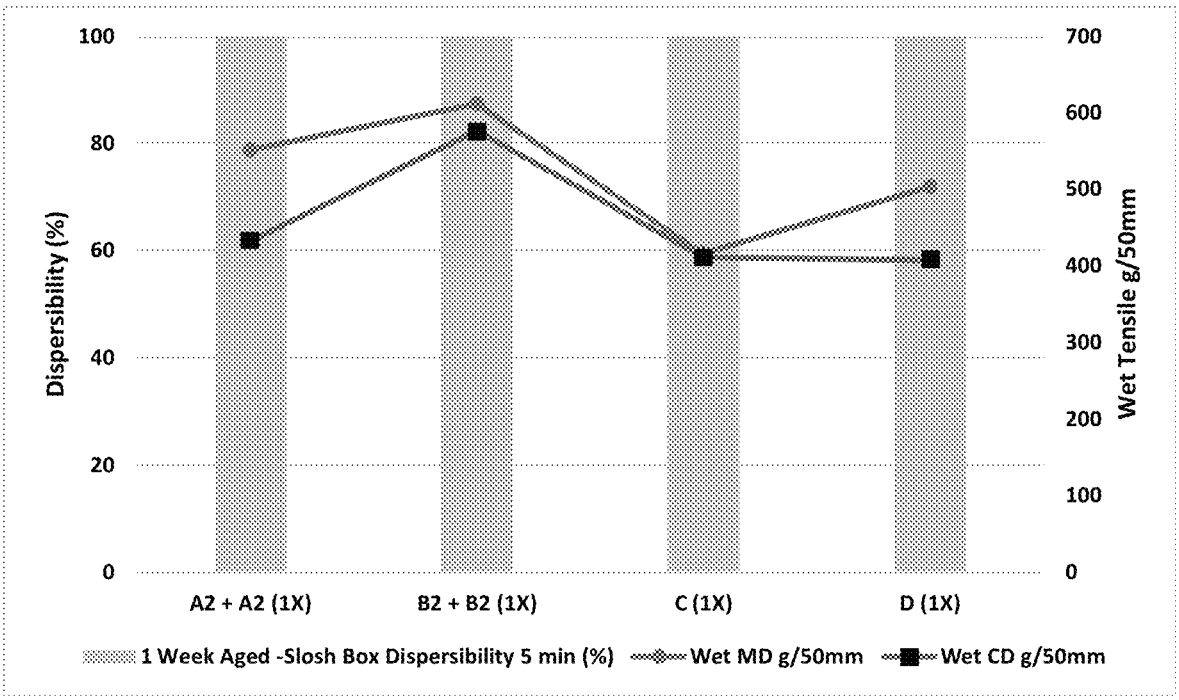
FIG. 3 shows wet MD and CD strength (line graph) and the slosh box (bar graph) profile of various nonwoven webs (multiple webs and single web) joined together by particle binder (2%) using a size press.

FIG. 3 shows the dispersibility (bars) and wet MD and CD data (lines) for four combination pairs of webs as shown in Table 1, using 2% of particle binder. It can be seen that double ply sample—A2+A2 (1×) and B2+B2 (1×); single ply—C (1×) and D(1×) shows 100% dispersibility after 5 min according to INDA/EDANA flushability GD3 guidelines, and all the samples shows wet strength greater than 250 g/50 mm. In FIG. 3, 1× denotes the hydroentanglement pressure used to make nonwoven web. 1× represents 200, 200 and 300 psi using three separate hydroentanglement nozzles.

The joined webs were then lotionized with a wetting solution 2.5 times the weight of the dry joined webs.

The invention claimed is:

1. A nonwoven fabric material comprising:

at least a first nonwoven web layer and a second nonwoven web layer, of which nonwoven web layers at least one is hydroentangled, wherein each of the first and second nonwoven web layers comprises a composition of 50%-95% by weight wood pulp and 5%-50% by weight synthetic fibers and/or natural fibers, and a basis weight of 20-100 gsm, the synthetic and/or natural fibers having a length of 5 to 15 mm, and wherein the first nonwoven web layer and the second nonwoven web layer are joined together by a binder solution comprising a composite of microcrystalline cellulose (MCC) and sodium carboxymethylcellulose (CMC) dispersed in water.

2. The nonwoven fabric material of claim 1, wherein at least one nonwoven web layer comprises synthetic fibers, and wherein the synthetic fibers are selected from the group consisting of regenerated cellulose, lyocell, viscose rayon, polylactic acid, and polyvinyl alcohol.

3. The nonwoven fabric material of claim 1, wherein at least one nonwoven web layer comprises natural fibers, and wherein the natural fibers are selected from the group consisting of cotton, hemp, flax, linen, bamboo, sisal, jute, and kapok.

4. The nonwoven fabric material of claim 1, further comprising a wetting liquid.

5. The nonwoven fabric material of claim 4, comprising the wetting liquid in an amount not exceeding 2.5 times a weight of the nonwoven fabric material per unit area.

6. The nonwoven fabric material of claim 1, wherein a wet strength of the nonwoven fabric material is greater than 250 g/50 mm.

7. The nonwoven fabric material of claim 1, wherein the least one nonwoven web layer comprises synthetic fibers, and wherein the synthetic fibers are not glass fibers or oil-based fibers.

8. A method for forming a nonwoven fabric material comprising:

applying a binder solution comprising a composite of microcrystalline cellulose (MCC) and sodium carboxymethylcellulose (CMC) dispersed in water to at least a first nonwoven web layer and a second nonwoven layer to join the first nonwoven web layer and the second nonwoven layer to one another, wherein at least one of the first nonwoven web layer or the second nonwoven web layer is hydroentangled, wherein each of the first and second nonwoven web layers comprises a composition of 50%-95% by weight wood pulp and 5%-50% by weight synthetic fibers and/or natural fibers, and a basis weight of 20-100 gsm, the synthetic and/or natural fibers having a length of 5 to 15 mm.

9. The method of claim 8, wherein the at least two nonwoven web layers are dried following the applying step.

10. The method of claim 8, wherein at least one nonwoven web layer comprises synthetic fibers, and wherein the synthetic fibers are selected from the group consisting of regenerated cellulose, lyocell, viscose rayon, polylactic acid, and polyvinyl alcohol.

11. The method of claim 8, wherein at least one nonwoven web layer comprises natural fibers, and wherein the natural fibers are selected from the group consisting of cotton, hemp, flax, linen, bamboo, sisal, jute, and kapok.

12. The method of claim 1, wherein each of the first the second nonwoven web layers are hydroentangled.

13. The nonwoven fabric material of claim 1, wherein a weight ratio of microcrystalline cellulose (MCC) to sodium carboxymethylcellulose (CMC) in the binder solution is from 80:20 to 95:5.

14. The nonwoven fabric material of claim 1, wherein the dispersibility of the composite material is 50-100%, according to INDA/EDANA flushability GD 3 guidelines.

15. The nonwoven fabric material of claim 1, wherein the dispersibility of the composite material is 80-100%, according to INDA/EDANA flushability GD 3 guidelines.

16. The nonwoven fabric material of claim 1, wherein the binder solution is present in an amount of from 1-2 wt % of the composite web.

17. The nonwoven fabric material of claim 1, wherein the nonwoven fabric material comprises 70-80 wt % wood pulp and 20-30 wt % short cut fibers.

18. The nonwoven fabric material of claim 1, wherein the particle binder comprises a particle size of from 2 μm to 150 μm.

* * * * *